US009420892B2

(12) United States Patent
Lejcher et al.

(10) Patent No.: US 9,420,892 B2
(45) Date of Patent: Aug. 23, 2016

(54) SEAT BOX WITH DROP-IN WEBBING ASSEMBLY

(71) Applicant: Ashley Furniture Industries, Inc., Arcadia, WI (US)

(72) Inventors: Christopher Jon Lejcher, Blair, WI (US); Timothy A. Brandtner, Ettrick, WI (US); Aaron Boe, Taylor, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 14/293,339

(22) Filed: Jun. 2, 2014

(65) Prior Publication Data

US 2014/0375103 A1 Dec. 25, 2014

Related U.S. Application Data

(60) Provisional application No. 61/829,734, filed on May 31, 2013.

(51) Int. Cl.

| | |
|---|---|
| ***A47C 7/00*** | (2006.01) |
| ***A47C 7/22*** | (2006.01) |
| ***A47C 4/02*** | (2006.01) |

(52) U.S. Cl.

CPC . *A47C 7/22* (2013.01); *A47C 4/028* (2013.01); *Y10T 29/49904* (2015.01)

(58) Field of Classification Search

CPC ..... A47C 4/02; A47C 7/282; A47C 5/06; A47C 7/20; A47C 7/30; A47C 17/225; A47C 17/22; A47C 17/16; A47C 19/024

USPC ..... 297/440.22, 440.15, 440.1, 452.64, 297/452.63, 452.56, 452.49, 452.52; 5/12.1, 29, 38, 310

See application file for complete search history.

(56) References Cited

U.S. PATENT DOCUMENTS

| | | | | |
|---|---|---|---|---|
| 3,813,709 | A * | 6/1974 | Friedman | A47C 17/136 5/12.1 |
| 4,305,616 | A * | 12/1981 | Martinez | A47C 4/028 297/411.27 |
| 5,007,681 | A * | 4/1991 | Meier | A47C 7/66 297/440.22 |
| 5,522,240 | A | 6/1996 | Wall et al. | |
| 5,538,325 | A | 7/1996 | Bullard | |
| 5,544,943 | A * | 8/1996 | Durling | A47C 23/18 267/103 |
| 5,738,414 | A * | 4/1998 | Wieland | A47C 4/02 297/219.1 |
| 6,367,880 | B1 * | 4/2002 | Niederman | A47C 4/02 297/440.14 |
| 7,300,111 | B2 * | 11/2007 | Huang | A47C 4/02 297/440.14 |
| 8,322,792 | B2 * | 12/2012 | Chen | A47C 13/005 297/232 |
| 8,646,843 | B2 * | 2/2014 | Koch | A47C 17/02 297/440.14 |

(Continued)

FOREIGN PATENT DOCUMENTS

WO WO 2012/135709 A2 10/2012

*Primary Examiner* — David E Allred
*Assistant Examiner* — Alexander Harrison
(74) *Attorney, Agent, or Firm* — Christensen Fonder P.A.

(57) ABSTRACT

A seat box assembly and method of fabricating utilizing a drop-in webbing assembly secured into a main box and back frame assembly. The webbing assembly has a rectangular frame with elongate members and shorter members and a central girder with a cutout extending between mid-portions of the elongate members. The central girder attachable to the seat box and a central vertical frame member of the back frame assembly. The elongate members having stub portions that fit into slots in the main seat box. A method of repair includes replacing a damaged drop-in assembly with a different drop-in assembly.

24 Claims, 10 Drawing Sheets

(56) References Cited

U.S. PATENT DOCUMENTS

| | | | | |
|---|---|---|---|---|
| 8,777,319 | B2 * | 7/2014 | Brandtner | A47C 4/02 29/91.1 |
| 2002/0017814 | A1 * | 2/2002 | Niederman | A47C 4/02 297/440.16 |
| 2003/0151292 | A1 | 8/2003 | McLarty et al. | |
| 2004/0140706 | A1 | 7/2004 | Harrison | |
| 2005/0225153 | A1 * | 10/2005 | Ou | A47C 4/028 297/440.1 |
| 2009/0102269 | A1 | 4/2009 | Dotta et al. | |
| 2011/0101763 | A1 * | 5/2011 | Chen | A47C 4/02 297/440.15 |
| 2012/0146382 | A1 * | 6/2012 | Griggs, Jr. | A47C 4/08 297/440.1 |

* cited by examiner

SEAT BOX WITH DROP-IN WEBBING ASSEMBLY

RELATED APPLICATIONS

This patent application claims the benefit of U.S. Provisional Patent Application No. 61/829,734, filed on May 31, 2013, the disclosure of which is hereby incorporated by reference herein in its entirety.

FIELD OF THE DISCLOSURE

The present disclosure is directed to a furniture item comprising a seat box. More specifically, the present disclosure is directed to a furniture item comprising a seat box having a drop in webbing assembly.

BACKGROUND OF THE DISCLOSURE

Currently, seat boxes available on the market often comprise a main box defining a hollow interior space, wherein a rigid plank to which a cushion or a plurality of cushions are affixed rests on the main box such that the cushioned rigid plank is supported over the interior space. The advantage of this type of seat box simplicity in design that is easily constructed. However, the rigid plank is typically impermeable to moisture, such that, should the cushion become moist or wet, the cushion may not fully dry out while in place. The collection of moisture or wetness can reduce the serviceable life of the cushion. An attempted solution was replacing the conventional wooden rigid plank with an air permeable rigid seat plank. The inherent drawback of both the conventional rigid plank and the air permeable rigid seat plank is that the limited flexibility of the seat plank is uncomfortable to seated individuals. The air permeable rigid seat planks were replaced with high tensile strength webbing stretched across the main box, wherein the cushion is affixed to the webbing. The webbing provides the advantages of both a flexible seating surface and a permeable support structure for the cushion. However, any damage to the main box or the webbing due to misuse or other causes requires that the entire seat box be replaced. Due to the size and weight of the seat box, replacement of the entire seat box can be challenging and inconvenient.

SUMMARY OF THE DISCLOSURE

Various embodiments of the disclosure are directed to a seat box with a drop in webbing assembly that provides the advantages of permeability and comfortableness, with the added advantage of more convenient installation and replacement. In some embodiments, the web assembly is separately inserted into the main frame and seat back assembly, supports the web tension without the need for attachment to the main frame and seat back assembly, and can be replaced as a unit if damaged. The web assemblies may be separately manufactured and utilized for field repairs. In certain embodiments, the web assembly is formed entirely of wood and/or wood products and does need steel cross supports between the principal elongate frame members.

Structurally, a seat box assembly is disclosed, comprising a main box including a front rail and a back rail separated by a pair of side rails to define an interior space. A back frame assembly extends vertically from the main box, the back frame assembly including a pair of side uprights and a middle upright. In one embodiment, each of the uprights is affixed to an interior face of the back rail, and each of the side uprights of the pair of side uprights extend upwards from a respective one of the pair of side rails of the main box to define an apex at the intersection of the side upright and the side rail. A drop-in webbing assembly is also disclosed, comprising a webbing frame including a forward spring rail and a rearward spring rail separated by a pair of cross rails, wherein each end of the rearward spring rail extends laterally beyond each of the cross rails to define a pair of protruding portions of the rearward spring rail. In certain embodiments, the drop-in webbing assembly further comprises a central girder attached to mid-portions of each of the elongate frame members, and a webbing spanning between the forward spring rail and the rearward spring rail. The central girder can comprise a wooden material. In various embodiments, structure defining a rearward notch is included proximate each apex of the side rails and the side uprights to define a pair of rearward notches, each of the rearward notches including a first lead-in structure on the respective side upright of the respective apex and a second lead-in structure on the respective side rail of the respective apex. In one embodiment, the second lead-in structure of each rearward notch is a chamfered lead-in structure. In one embodiment, the drop-in webbing assembly is removably attached to the main box and back frame as a unit with the webbing and the central girder attached thereto.

Each of the side rails of the pair of side rails can further comprise structure defining a forward notch proximate the front rail. Each of the forward notches can include a third lead-in structure. In various embodiments, the third lead-in structure comprises chamfered lead-in structure. In one embodiment, a tapered face the chamfered lead-in structure of the second lead-in structure faces in a direction towards the back rail and a tapered face of the chamfered lead-in structure of the third lead-in structure faces in a direction towards the front rail.

In various embodiments, the central girder of the drop-in webbing assembly includes a forward block and a rearward block connected by a cross member, the forward block including a first notch formed thereon, the rearward block including a second notch formed thereon. In these embodiments, the forward spring rail can be disposed in the first notch of the forward block, and the rearward spring rail can be disposed in the second notch of the rearward block. In one embodiment, the forward block includes an extension portion that extends beyond the forward block in a forward direction. The front rail can define a notch that is open to an upper edge of the front rail, and the extension portion of the forward block can be registered in the notch of the front rail. In some embodiments, the rearward block includes an extension portion that extends beyond the second notch of the rearward block in a rearward direction. The back rail can define a notch that is open to a lower edge of the back rail, and the extension portion of the rearward block is registered in the notch of the back rail. In various embodiments, the rearward block is affixed to the middle upright. The webbing can comprise a plurality of webbing straps.

In a method embodiment of the disclosure, a method of assembling a seat box includes:

providing a sub assembly comprising: a main box including a front rail and a back rail separated by a pair of side rails to define an interior space, the main box including upper edges that substantially define a plane; and a back frame assembly extending vertically from the main box, the back frame assembly including a pair of side uprights and a middle upright, each of the side uprights of the pair of side uprights extending upwards from a respective one of the pair of side rails of the main box to define an apex at the intersection of the side upright and the side rail, wherein structure defining a rearward notch is included proximate each apex of the side rails and the side uprights to define a pair of rearward notches, each of the rearward notches including at least one lead-in structure and a support face;

providing a drop-in webbing assembly comprising: a webbing frame including a forward spring rail and a rearward spring rail separated by a pair of cross rails, wherein each end of the rearward spring rail extends laterally beyond each of the cross rails to define a pair of protruding portions of the rearward spring rail; and a central girder attached to mid-portions of each of the elongate frame members, the central girder including a rearward block affixed to the rearward spring rail of the webbing frame;

inserting the drop-in webbing assembly into the interior space of the main box so that the rearward block of the central girder is immediately adjacent a lateral face of the middle upright of the back frame assembly, the drop-in webbing assembly being inserted at an acute angle relative to the plane of the upper edges of the main box;

disposing each protruding portion of the pair of protruding portions into a respective one of the rearward notches via the at least one lead-in structure;

rotating the drop-in webbing assembly about the rearward spring rail when the pair of protruding portions are lodged within the rearward notches, so that the forward spring rail is rotated towards the main box; and registering the drop-in webbing assembly within the main box, so that the rearward spring rail is registered against the support faces of the rearward notches.

The method can further comprise sliding the pair of protruding portions over the at least one lead-in structure to stretch the webbing frame. In one embodiment, the at least one lead-in structure of each of the rearward notches of the subassembly provided in the step of providing a subassembly are chamfered lead-in structures. Also, the at least one lead-in structure of each of the rearward notches of the subassembly provided in the step of providing a subassembly can include a first lead-in structure on the respective side upright of the respective apex and a second lead-in structure on the respective side rail of the respective apex.

Each side rail of the pair of side rails of the subassembly provided in the step of providing a subassembly can includes a forward notch to define a pair of forward notches, each forward notch including a support face. In one embodiment, the forward spring rail of the webbing frame provided in the step of providing a drop-in webbing assembly extends laterally beyond each of the cross rails to define a pair of protruding portions of the forward spring rail, and the protruding portions of the forward spring rail are placed in contact with the support faces of the pair of forward notches during the step of registering the drop-in webbing assembly within the main box.

In one embodiment, each of the forward notches includes a lead-in structure, and the method further comprises sliding the pair of protruding portions of the forward spring rail over the lead-in structures of the pair of forward notches to stretch the webbing frame. In various embodiments, the webbing frame provided in the step of providing a drop-in webbing assembly includes a webbing.

In one embodiment, a seat box comprises a main box and a webbing assembly. The main box comprises a rectangular seat frame defining the seating portion and a back frame set vertically on one side of the rectangular seat frame. The webbing assembly further comprises a plurality of webbing strips and a rectangular webbing frame having two parallel primary or spring rails and two cross-rails at the ends of the spring rails to define the rectangular frame. Each cross-rail is positioned inward of the ends of the spring rails such that a protruding portion of the spring rails protrudes past the cross-rail, wherein the spring rails are sized to correspond to the dimensions of the seat box such that the spring rails can rest on the rectangular seat frame. In certain embodiments, the rectangular seat frame comprises at least one notch for receiving the protruding portion of the spring rail. The webbing assembly also comprises a central girder parallel to the cross-rails at the center the spring rails. The wooden central girder is sized to extend beyond the spring rails such that a portion of the central girder extends past the cross-rail such that the central girder can engage the rectangular seat frame. The rectangular seat frame can further comprise at least one notch for receiving the extended portion of the central girder. In certain embodiments, the notches comprise chamfered or stepped lead-ins such that the protruding portions of the webbing frame are insertable flush into the notches.

In certain embodiments, the main box can further comprise legs positioned at the corners of the main box for elevating the seat box.

In certain embodiments, the ends of the webbing strips are affixed to the spring rails such that the webbing strips extend between the spring rails. In certain embodiments, a portion of the webbing strips can be secured to the cross-rails of the webbing assembly such that the webbing strips are arranged in a crisscross or parallel knitted webbing. The webbing frame can further comprise gussets positioned at the corners of the webbing frame to reinforce the frame.

The above summary of the various representative embodiments are is not intended to describe each illustrated embodiment or every implementation. Rather, the embodiments are chosen and described so that others skilled in the art can appreciate and understand the principles and practices of the disclosure. The figures in the detailed description that follow more particularly exemplify these embodiments.

DETAILED DESCRIPTION

Figure 1:
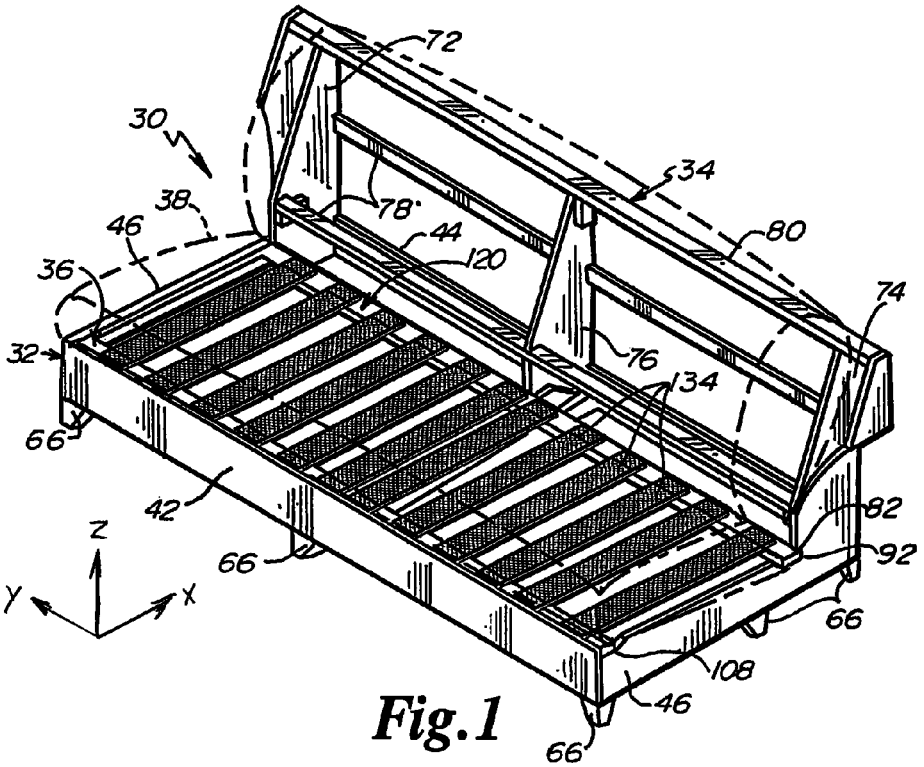
FIG. 1 is a perspective view of a seat box assembly in an embodiment of the disclosure.

As depicted in FIGS. 1 through 12, a seat box assembly 30 is depicted in an embodiment of the disclosure. The seat box assembly 30 includes a main box 32, a back frame assembly 34, a drop-in webbing assembly 36, and at least one cushion 38. The main box 32 comprises a front rail 42, a back rail 44, and two side rails 46, each of the rails 42, 44, and 46 including a respective interior face 52, 54, and 56 that defines and bounds an interior space 48. In one embodiment, the side rails 46 each include a mounting block 58 affixed to the interior face 56 thereof. The main box 32 can also include a bottom panel 62 that defines a floor 64 of the interior space 48. In certain embodiments, the main box 32 can further comprise a plurality of legs 66 positioned at the corners for elevating the seat box. The legs 66 can be positioned at the corners, on the front and back rails 42 and 44 along the length of main box 32, and/or on the side rails 46.

Figure 2:
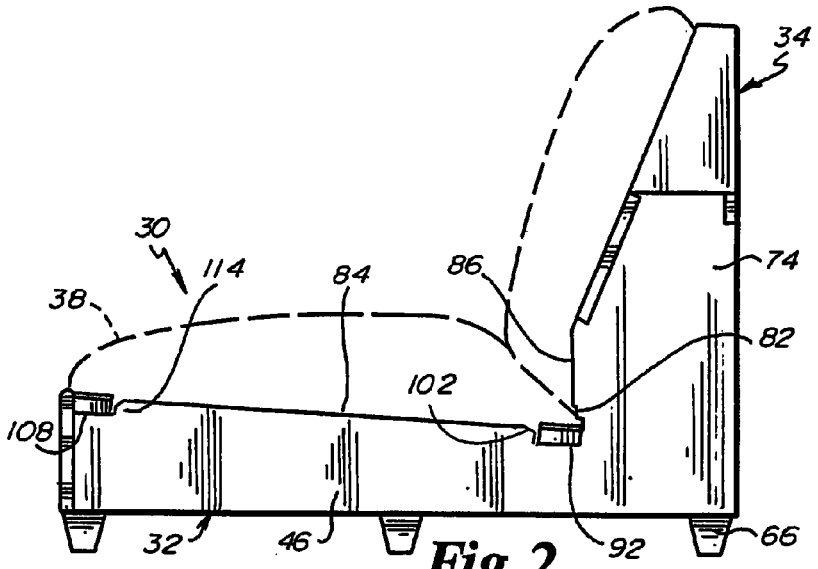
FIG. 2 is a side view of the seat box assembly depicted in FIG. 1.
Figure 3:
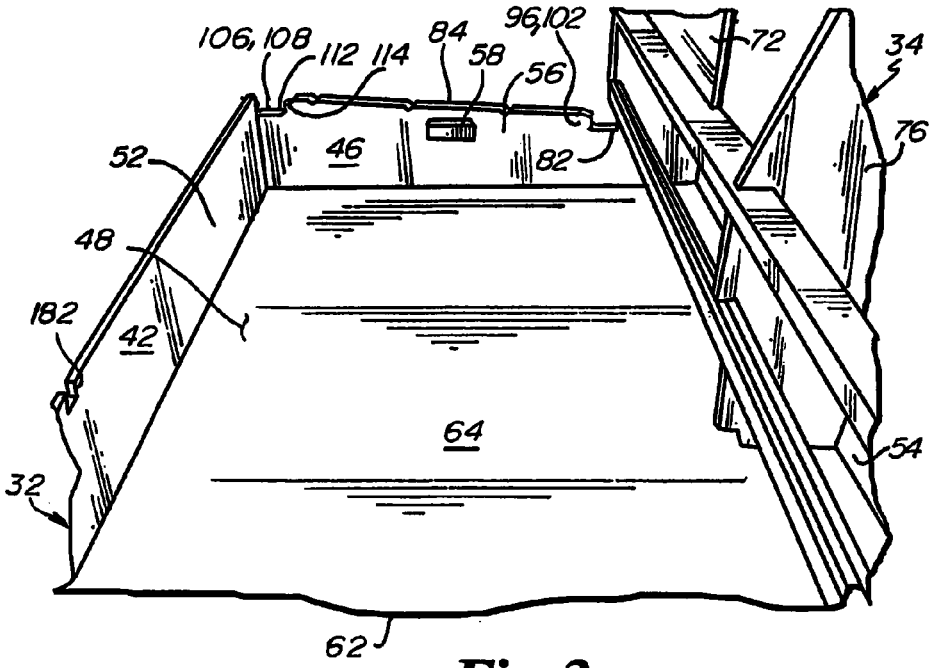
FIGS. 3 and 4 are perspective views of a main box and a back frame set in an embodiment of the disclosure.
Figure 4:
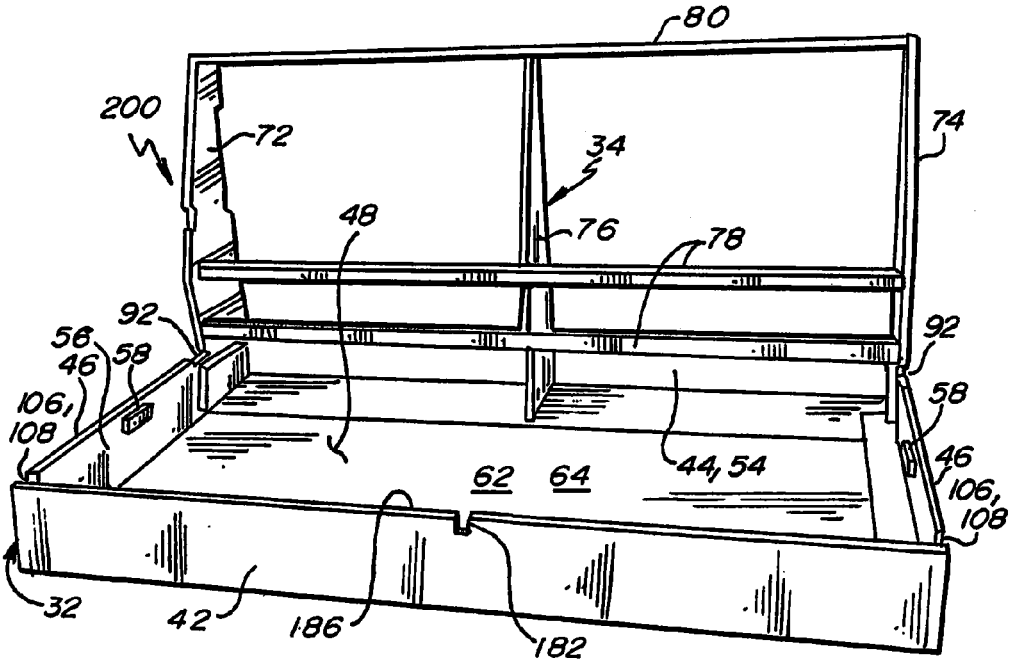
Figure 5:
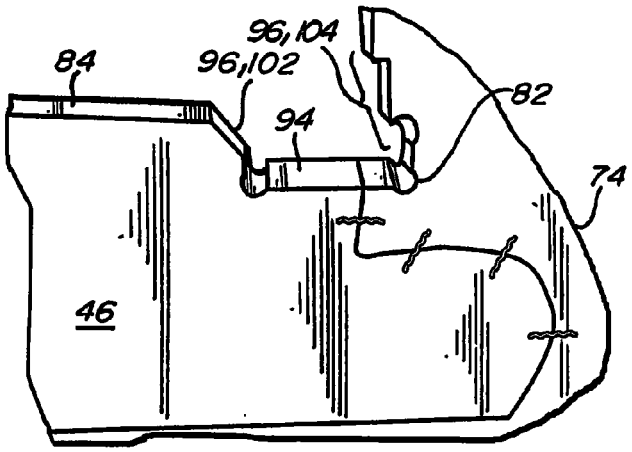
FIG. 5 is a perspective view of a joint between the main box and the back frame set in an embodiment of the disclosure.
Figure 6:
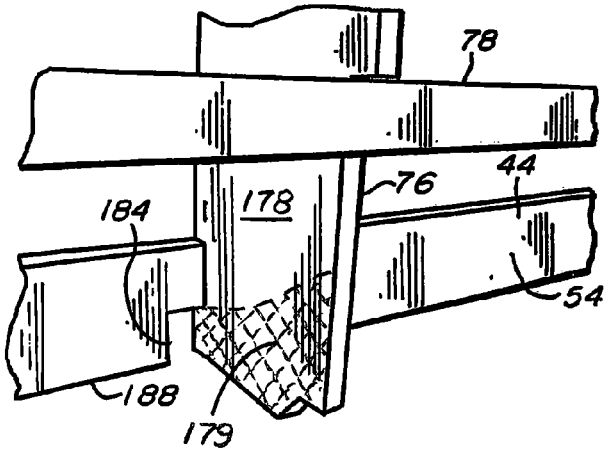
FIG. 6 is a perspective view of a middle support of the back frame in an embodiment of the disclosure.
Figure 7:
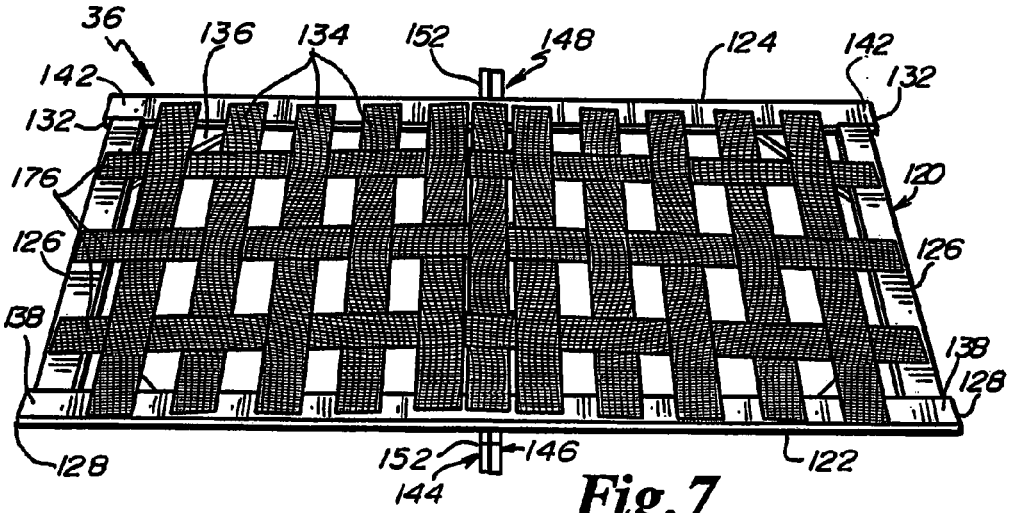
FIG. 7 is a perspective view of a top side of a webbing assembly in an embodiment of the disclosure.
Figure 8:
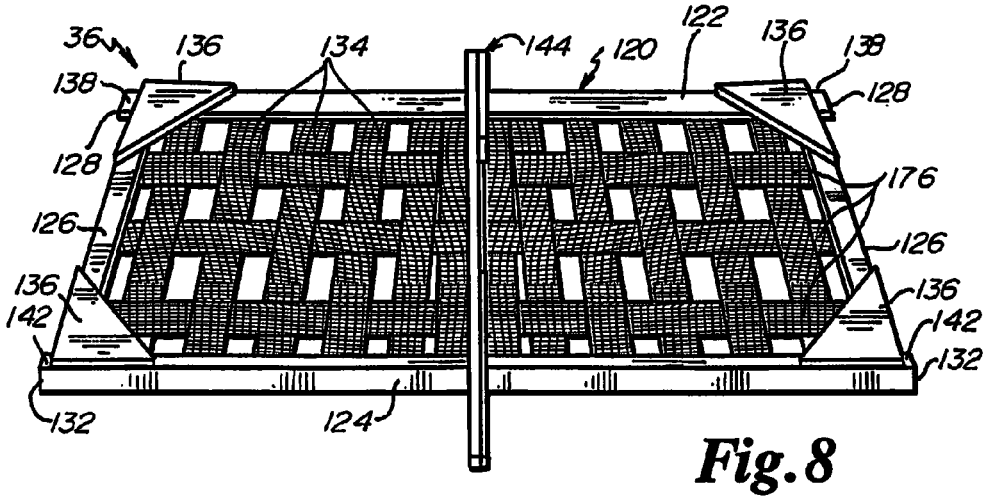
FIGS. 8 and 9 are bottom perspective views of a seat box webbing in an embodiment of the disclosure.

The back frame assembly 34 can comprise a pair of side uprights 72 and 74 (i.e., a left upright 72 and a right upright 74) and a middle upright 76, extending vertically from the back rail 44 of the main box 32 and tied together by backrest rails 78 and/or a cap rail assembly 80. In one embodiment, the back frame assembly 34 is affixed to the back rail 44 of the main box 32. Each of the side uprights 72, 74 can extend upwards from a respective one of the side rails 46, defining an apex 82 where an upper edge 84 of the respective side rail 46 and a forward edge 86 of the respective side upright 72 or 74 intersect. In some embodiments, the left and right uprights 72 and 74 are integral to the side rails 46 (i.e., cut from the same panel stock, such as depicted in FIGS. 1 and 2); in other embodiments, each of the left and right uprights 72 and 74 are inserted between the respective side rail 46 and the back rail 44 to abut the respective side rail 46 and are joined thereto, for example with staples (FIG. 5). In one embodiment, the middle upright 76 is disposed within the main box 32 and affixed to the interior surface 54 of the back rail 44. Also, unlike certain conventional seat box designs, the middle upright 76 of the depicted back frame assembly 34 does not include a spring rail retainer.

The side rails 46 of the main box can each define a rearward notch 92 proximate the apex 82 at the junction of the side rail 46 and the side upright 72 or 74. Each rearward notch 92 is characterized as including a support face 94, to which weight is transferred from the drop-in webbing assembly 36 in a load bearing relationship. In one embodiment, the rearward notch 92 includes one or more lead-in structures 96. In the depiction of FIG. 5, two examples of such lead-in structures are presented: a tapered or chamfered lead-in structure 102 formed on the side rail 46 that defines an obtuse angle relative to the support face 94 of the rearward notch 92; and a stepped lead-in structure 104 formed on the adjoining side upright 72 or 74. Other lead-in structures, including convex-arcuate or concave-arcuate profiled edges (not depicted) can also be utilized. Each side rail 46 can further define a forward retention structure 106, such as a forward notch 108 formed proximate the front rail 42 of the main box 32. The forward notches 108 are also characterized as including a support face 112, and can also define a lead-in structure 114. Other forward retention structures include a notch (not depicted) formed on the front rail 42, or a structure such as a pocket or notch attached to the interior of the main box (not depicted), proximate the corner of the webbing assembly 36 and adapted to receive the webbing assembly 36.

The webbing assembly 36 comprises a webbing frame 120 having a forward spring rail 122, a rearward spring rail 124, and a pair of parallel cross-rails 126 positioned proximate the ends 128 and 132 of the forward and rearward spring rails 122 and 124, respectively. A plurality of webbing straps 134 are mounted to the webbing frame 120, spanning between the forward and rearward spring rails 122 and 124. In one embodiment, the webbing frame 120 can be further supported by gussets 136. The cross-rails 126 can be positioned to define protruding portions 138, 142 at the ends 128 and 132 of the forward and rearward spring rails 122 and 124, respectively, that protrude laterally beyond the cross-rails 126.

The webbing assembly 36 can further comprise a central girder 144 that extends between the forward and rearward spring rails 122 and 124 and is substantially parallel to the cross-rails 126. In one embodiment, the central girder 144 comprises a forward block 146 and a rearward block 148 connected by a cross member 152. In one embodiment, the forward and rearward blocks 146 and 148 are mounted to the same side of the cross member 152. The forward and rearward blocks 146 and 148 can each include a respective notch 156 and 158 defined thereon. The forward block 146 can further include a registration block 162 that is mounted flush with the notch 146. In one embodiment, the registration block 162 includes an extended portion 164 that extends beyond the forward block 146 in the forward direction.

Figure 9:
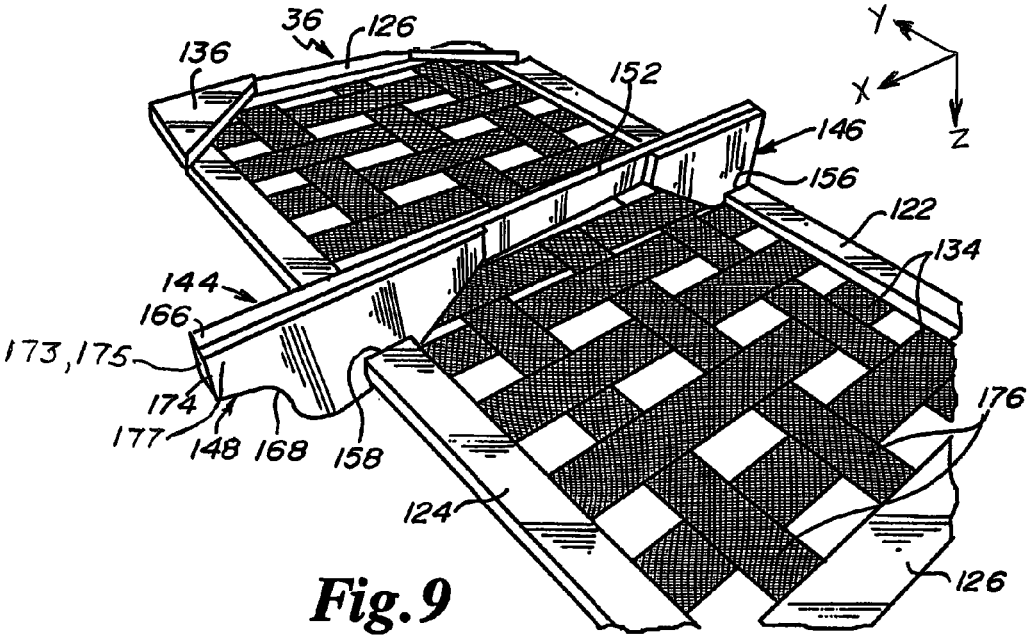
Figure 10:
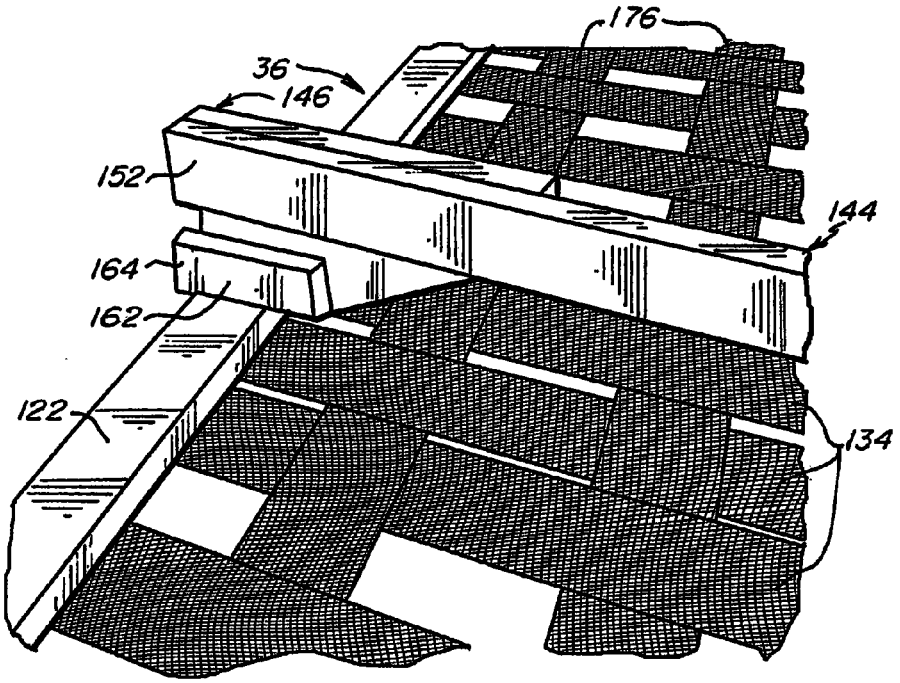
FIGS. 10 and 11 are perspective views of the center support frame of the webbing assembly in an embodiment of the disclosure.
Figure 11:
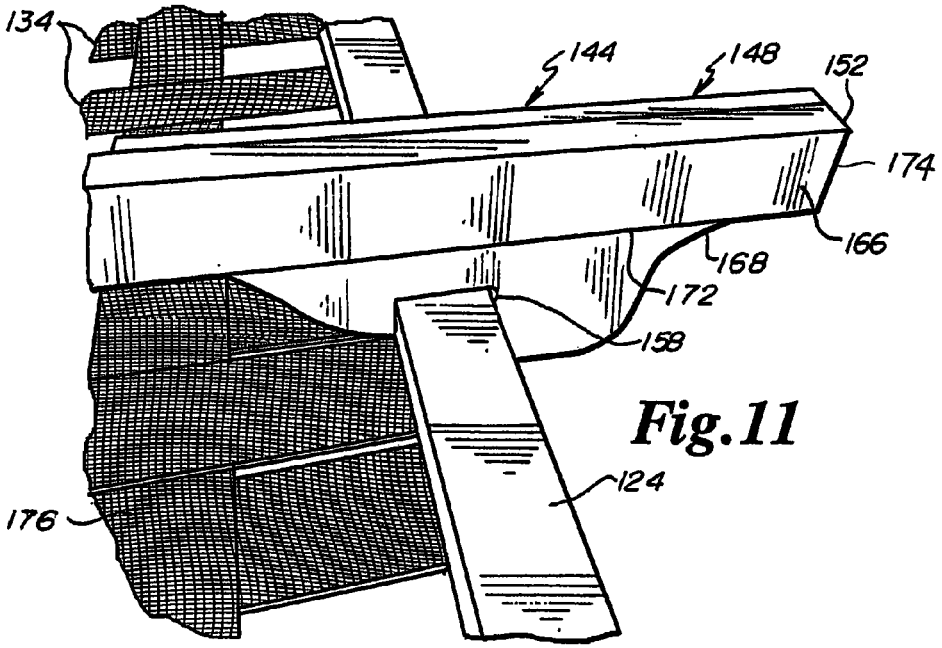
Figure 12:
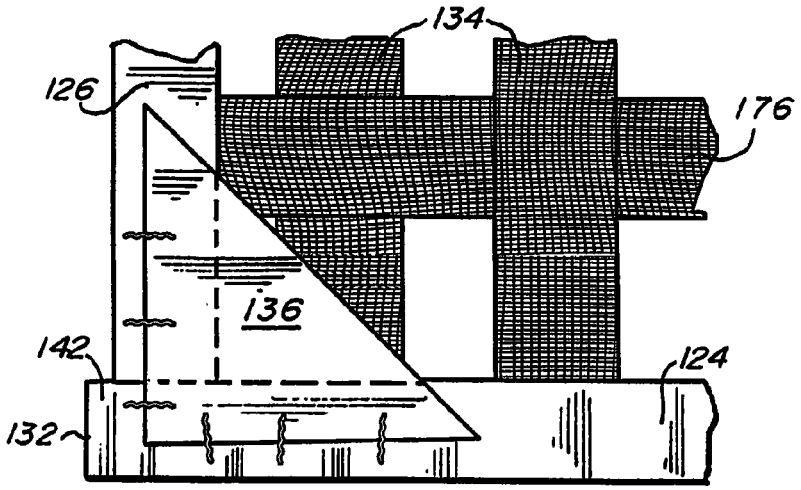
FIG. 12 is a perspective view of a corner gusset of the webbing assembly in an embodiment of the disclosure.

In one embodiment, the rearward block 148 includes an extended portion 166 that extends rearward of the notch 158 formed thereon, and includes a contoured surface 168 that tapers to a height that is flush with a top edge 172 of the cross member 152 at a back end 174 of the central girder 144. The back end 174 of the central girder 144 can be characterized as including a rearward face 173 (i.e., substantially perpendicular to the x-direction) having a rearward face area 175 and an exposed lateral face 177 (i.e., substantially perpendicular to the y-direction) of the rearward block 148, as depicted in FIG. 9. In one embodiment, when the seat box 30 is assembled, the exposed lateral face 177 of the rearward block 148 overlaps with a lateral face 178 of the middle upright 76 to define an overlapping contact area 179, depicted in phantom shading in FIG. 6. In one embodiment, an area ratio of the overlapping contact area 179 to the rearward face area 175 is between 2 and 20 inclusive. In other embodiments, the area ratio is between 2 and 10 inclusive. In still other embodiments, the area ratio is between 4 and 10 inclusive.

The forward and rearward spring rails 122 and 124 of the webbing frame 120 are seated within the notches 156, 158 of the forward and rearward blocks 146 and 148 of the central girder 144, and can be affixed to the central girder 144, for example, with staples and/or glue. In one embodiment, the location of the central girder 144 on the forward and rearward spring rails 122 and 124 is such that, when the webbing assembly 36 is disposed in the main box 32, the rearward block 148 is immediately adjacent or registers against a lateral face 178 the middle upright 76 of the back frame assembly 34.

In certain embodiments, each webbing strap 134 can be affixed at the ends to the forward and rearward spring rails 122 and 124 such that the webbing straps 134 are suspended between the forward and rearward spring rails 122 and 124 (e.g., FIG. 1). In other embodiments, cross-webbing straps 176 can extend between and be affixed to the ends to the cross-rails 126 and interwoven with the webbing straps 134 extending between the forward and rearward spring rails 122 and 124 (e.g., FIG. 3).

The gussets 136 can be positioned at the four corners of the webbing frame 120. The gussets 136 reinforce the webbing frame 120 to prevent collapse of the forward and rearward spring rails 122 and 124 and cross-rails 126 due the tension load exerted on the webbing frame 120 by the webbing straps 134 and the cross-webbing straps 176. The gussets 136 can be affixed to the webbing frame 120 using known mechanical fastening techniques (e.g., staples, nails, screws) and/or by gluing.

In one embodiment, the front rail 42 and back rail 44 of the main box 32 each define a respective registration notch 182 and 184 for receiving the extended portions 164, 166 of the central girder 144. In one embodiment, the registration notch 182 of the front rail 42 is open to an upper edge 186 of the front rail 42, whereas the registration notch 184 of the back rail 44 is open to a lower edge 188 of the back rail 44.

In assembly, fixturing (not depicted) can be used during buildup of the webbing assembly 36 to assure proper distances and orientation are maintained during placement of components. Examples of distances and placement that can be maintained by the fixturing include the protruding portions 138 and 142 of the forward and rearward spring rails 122 and 124 beyond the side rails 126, location of the gussets 136, and the location of the central girder 144. The rearward notches 92 of the side rails 46 receive the protruding portions 142 of the rearward spring rail 124. In certain embodiments, the rearward notches 92 can be positioned such that the webbing assembly 36 is aligned with the main box 32 as the webbing assembly 36 is inserted therein.

Functionally, the central girder 144 provides mid-span support of the webbing assembly 36 within the main box 32, and also maintains the spacing of the forward and rearward spring rails 122 and 124 at the mid span. Maintaining the spacing of the forward and rearward spring rails 122 and 124 can also maintain the webbing straps 134 at a desired level of tension for support of the cushion 38. In one embodiment, the registration block 162 and a support face of the notch 156 of the forward block 146 combine to provide a mounting surface for the forward spring rail 122. For embodiments including the extended portion 164 of the registration block 162 that extends beyond the forward block 146, the registration block 162 can also mate with the registration notch 182 of the front rail 42 of the main box 32. The overlapping contact area 179, being larger than the rearward face area 175, can provide attachment points between the central girder 144 and the middle upright 76 that are spaced further apart than attachment points would be on the rearward face area 175, enhancing the relative strength and stability of the joint between the central girder 144 and the middle upright 76.

Figure 13:
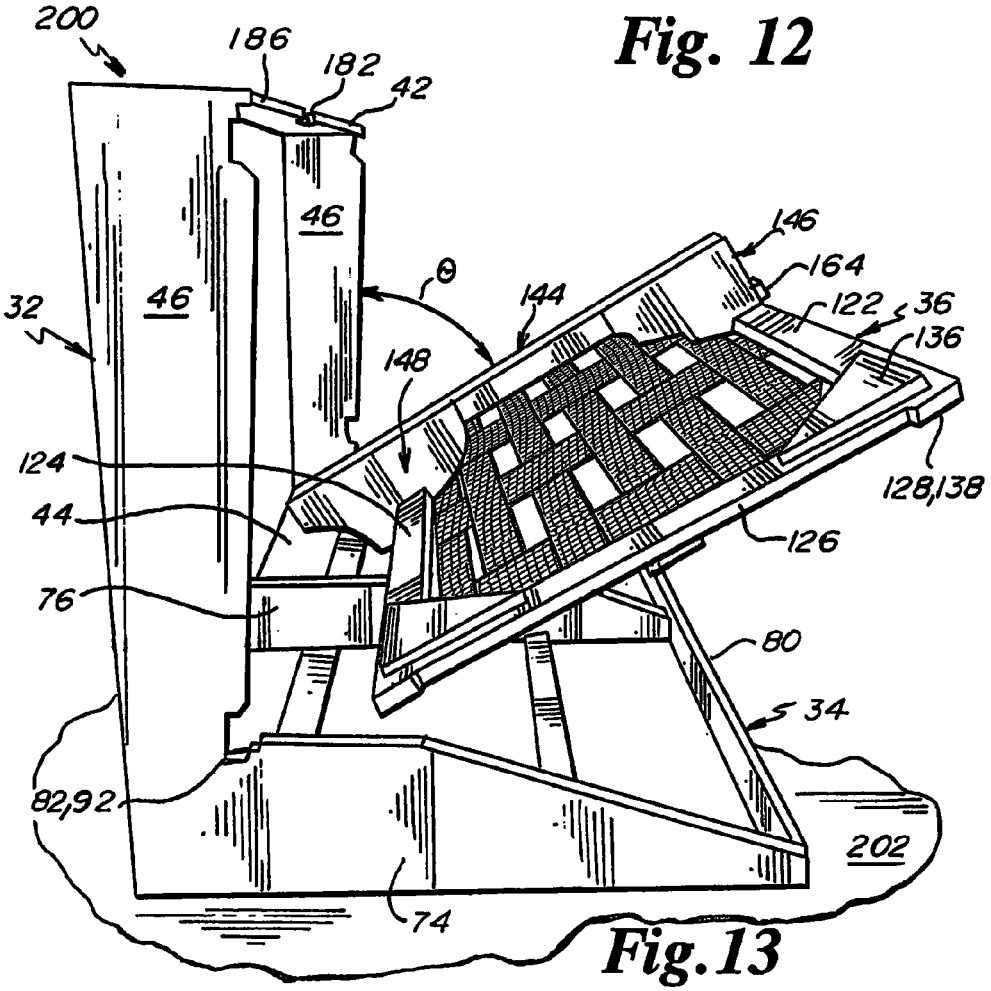
FIGS. 13-20 are is a perspective views of the webbing assembly being inserted into a subassembly of a rectangular seat frame and a back frame in an embodiment of the disclosure.

Referring to FIGS. 13-20, installation of the drop-in webbing assembly 36 into the main box 32 is depicted in an embodiment of the disclosure. In the depictions, the back frame assembly 34 is mounted on one side of the main box 32 as a subassembly 200, with the subassembly 200 rotated 90 degrees so that the back frame assembly 34 and the back rail 44 are registered on an assembly plane 202 (FIG. 13). (The assembly plane 202 can comprise, for example, the floor of an assembly area, as depicted, or a bench top.) In this orientation, the substructures within the main box 32 are readily accessible for assembly operations, such as the fastening of assembled components to each other. It is noted, however, that other assembly orientations for the subassembly 200 can be utilized, for example: in the normally upright position; on its side with one of the side rails 46 and side uprights 72 or 74 registered on the assembly plane 202; or on a fixture that orients the subassembly 200 in a desired orientation.

Figure 14:
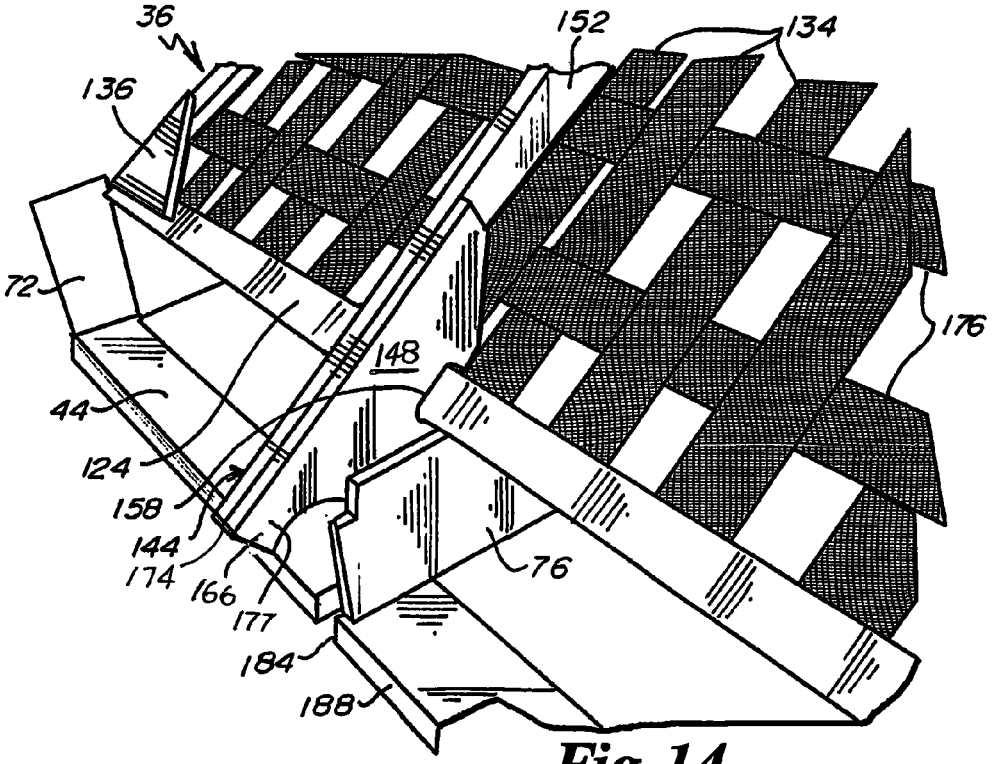
Figure 15:
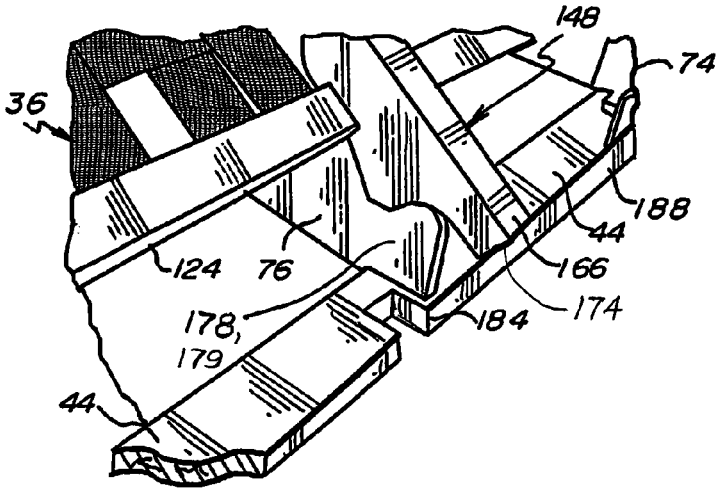
Figure 16:
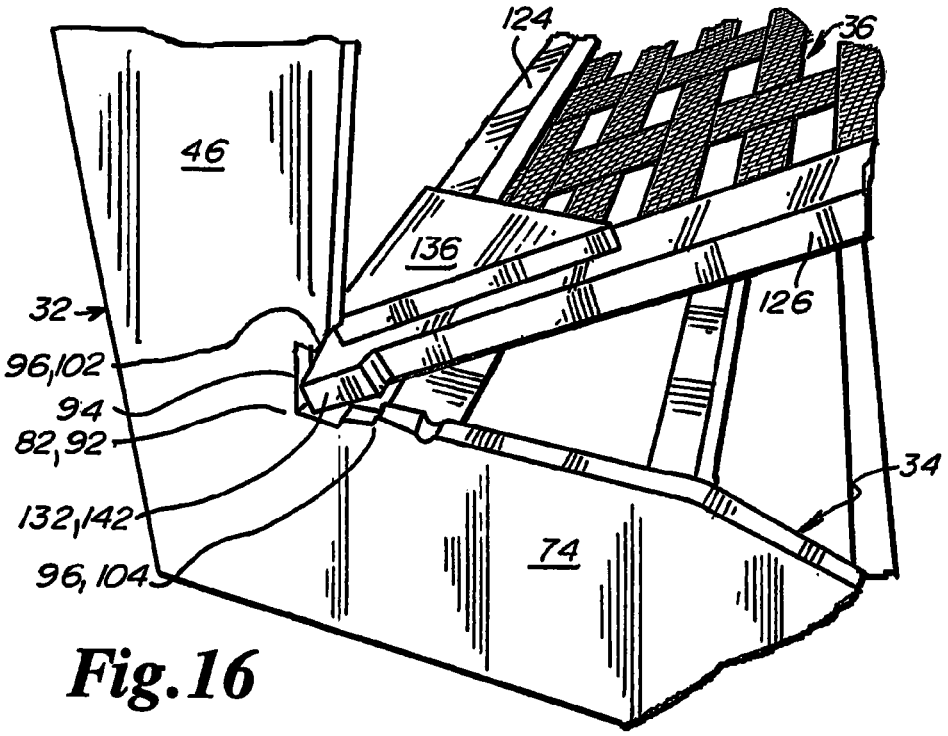
Figure 17:
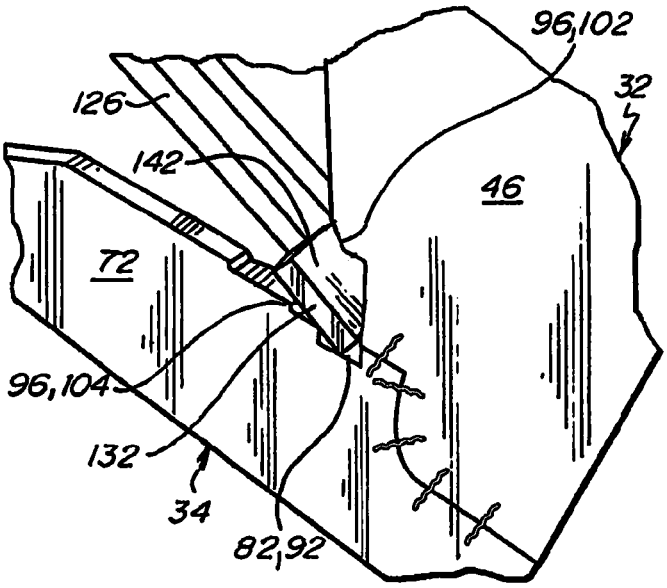
Figure 18:
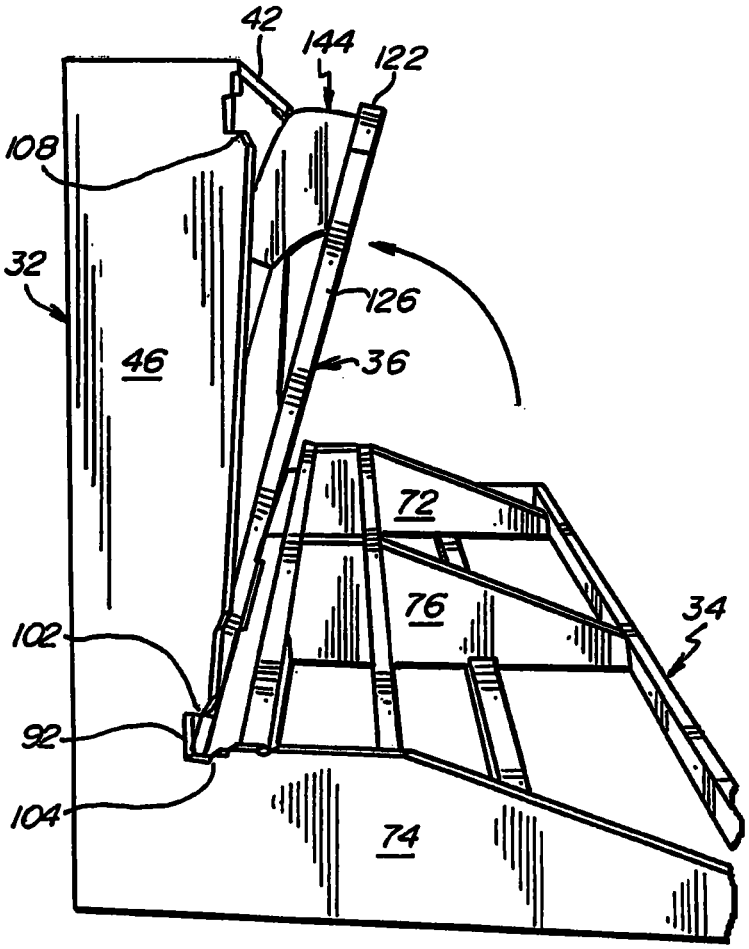

With the subassembly 200 in the assembly orientation, the webbing assembly 36 is inserted into the subassembly 200 at an acute angle θ relative to the upper edges 84, 186, of the main box 32 (FIG. 13), with the rearward block 148 of the central girder 144 aligned to be adjacent a pre-designated side of the middle upright 76 (FIGS. 14 and 15). As the insertion operation progresses, the protruding portions 142 of the rearward spring rail 124 enter the rearward notches 92 of the side rails 46 of the main box 32 by passing over the lead-in structures 96 of the left and right uprights 72 and 74 (FIGS. 16 and 17).

Figure 20:
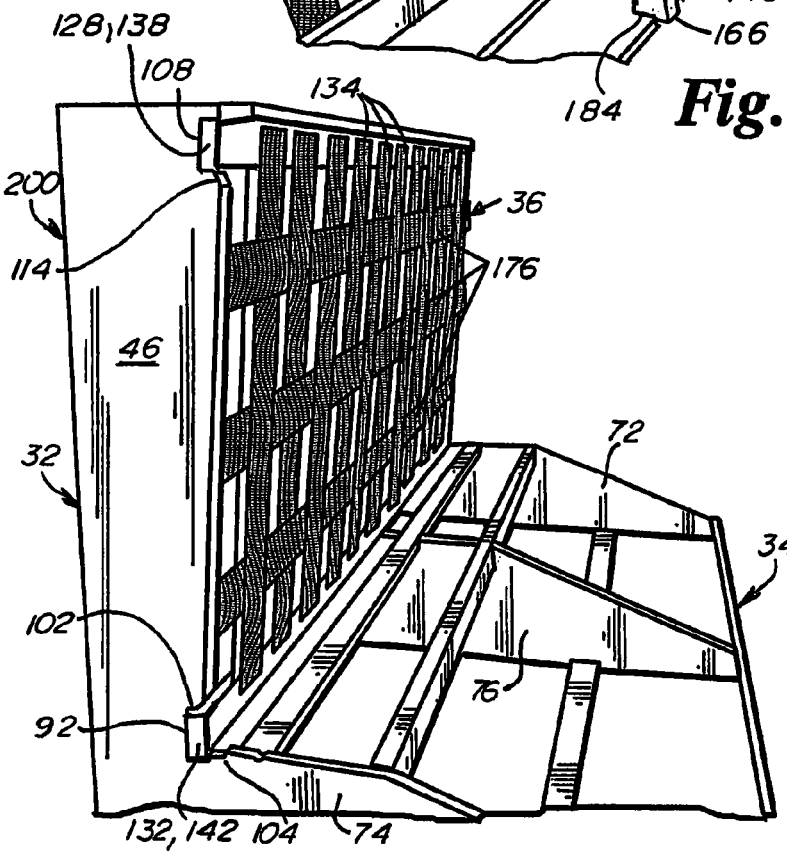

Once the protruding portions 142 of the rearward spring rail 124 are disposed in the rearward notches 92, the webbing assembly 36 is rotated about the rearward spring rail 124 toward the main box 32 (FIGS. 18 and 19) until the forward spring rail 122 is fully registered on the main box 32 (FIG. 20). For embodiments that utilize protruding portions 138 on the forward spring rails 122 and forward notches 108 on the side rails 46, full registration is accomplished when the protruding portions 138 of the forward spring rails 122 contact the support faces 112 of the forward notches 108. Another indicia of full registration is when the cross members 126 of the webbing frame 120 make contact with the mounting blocks 58 of the side rails 46. Also during the rotation of the webbing assembly 36, for embodiments utilizing the registration notches 182, 184 on the front and back rails 42 and 44, the extended portions 164, 166 of the central girder 144 rotate into the respective registration notches 182, 184.

Once the webbing assembly 36 is fully registered within the main box 32, the webbing assembly 36 can be affixed to the subassembly 200. For example: the rearward block 148 can be affixed to the middle upright 76; the cross-rails 126 of the webbing frame 120 can be affixed to the side rails 46 of the main box 32; and/or the forward spring rail 122 can be affixed to the front rail 42 of the main box 32. Fixing the webbing assembly 36 to the main box 32 can be accomplished, for example, by gluing and/or by standard fastening techniques such as stapling, nailing, screwing, or bolting. It is noted that, for some embodiments, it is desirable to have the webbing assembly 36 be removable from the subassembly 200 after installation, for replacement or repair. In such embodiments, certain fastening methods are favored, such as bolting, that can be readily reversed after installation.

Figure 21:
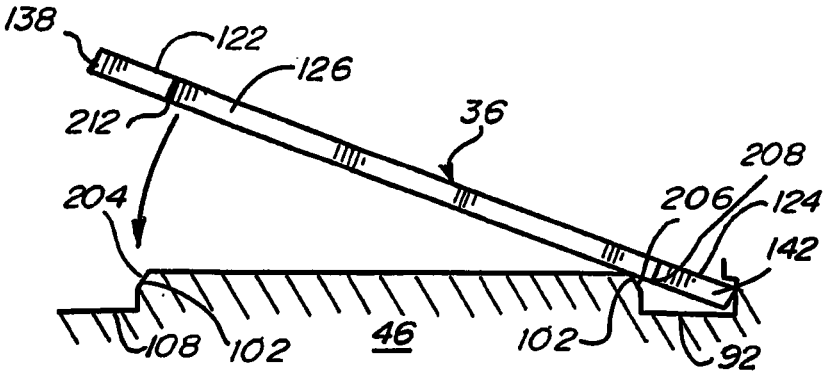
FIG. 21 is a schematic of a drop-in webbing assembly installed with opposed lead-ins on forward and rearward notches in an embodiment of the disclosure.
Figure 19:
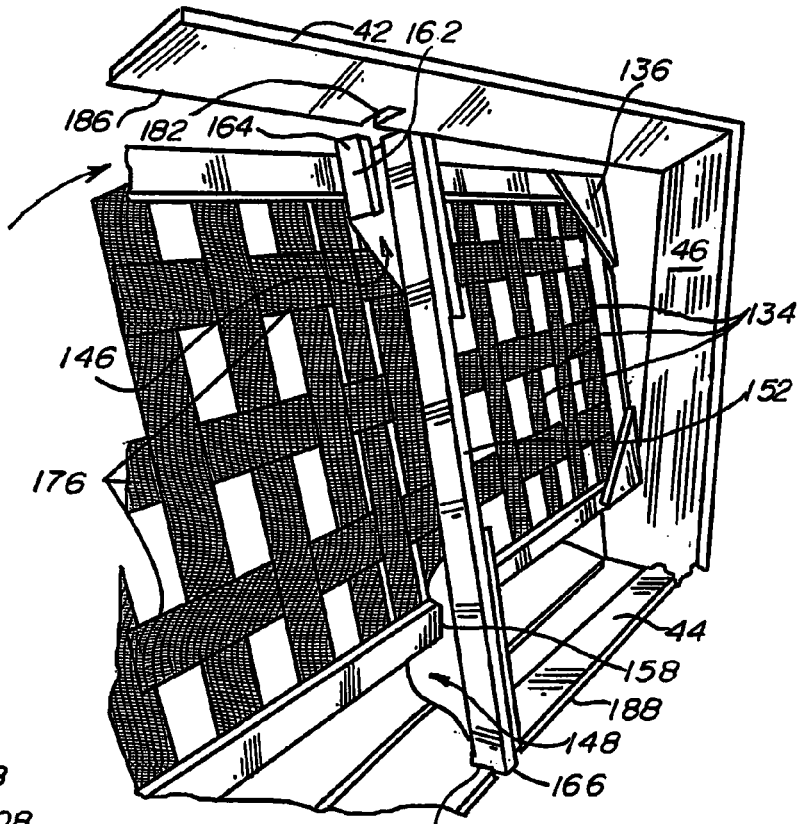

Referring to FIG. 21, an arrangement wherein the forward and rearward notches 108 and 92 of the side rails 46 define the chamfered lead-in structures 102 that face away from each other is schematically depicted in an embodiment of the disclosure. A tapered face 204 of the chamfered lead-in 102 of the forward notch 108 faces forward, while a tapered face 206 of the chamfered lead-in 102 of the rearward notch 92 faces rearward. Accordingly, during rotation of the webbing assembly 36, a forward edge 208 the rearward spring rail 124 may rotate against the tapered face 206 of the rear notches 92. Likewise, a rearward edge 212 of the forward spring rail 122 may contact the tapered face 204 of the chamfered lead-in 102 of the forward notch 108. In this embodiment, as the webbing frame 120 is driven into the forward and rearward notches 108 and 92, the protruding portions 138, 142 of the forward and rearward spring rails 122 and 124 slide over the chamfered lead-ins 102 and are driven away from each other, effectively stretching the webbing frame 120 and the webbing straps 134 thereof. It is further noted that the stretching action can be effected by having a lead-in structure 96 on only one of the notches 92 or 108 of each side rail 46. For example, the forward spring rail 122 could be set within a square notch having no lead in, and the rearward spring rail driven to slide over the chamfered lead-in 102 of the rearward notch 92 before registering within the rearward notch 92 to effect the stretching. Likewise, a forward notch 108 with a chamfered lead-in 102 juxtaposed with a square rearward notch 92 can accomplish the same stretching action.

The depicted embodiments present a webbing assembly 36 with webbing straps 134 and cross-webbing straps 176 installed on the webbing frame 120 prior to insertion into the subassembly 200. It is noted that, for other embodiments, the webbing and cross-webbing straps 134 and 176 can be attached to the webbing frame 120 after installation into the subassembly 200.

Also, the depicted embodiments present a single middle upright 76 and a single central girder 144. It is understood that such depiction does non-limiting; that is, more than one middle upright that cooperate with more than one central girder for seat boxes of extended width in the y-direction is contemplated.

While the disclosure is amenable to various modifications and alternative forms, specifics thereof have been shown by way of example in the drawings and described in detail. It is understood, however, that the intention is not to limit the application to the particular embodiments described. On the contrary, the intention is to cover all modifications, equivalents, and alternatives falling within the spirit and scope of the disclosure as defined by the appended claims.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A seat box assembly, comprising:

a main box including a front rail and a back rail separated by a pair of side rails to define an interior space;

a back frame assembly extending vertically from said main box, said back frame assembly including a pair of side uprights and a middle upright, each of the uprights being affixed to an interior face of said back rail, each of the side uprights of said pair of side uprights extending upwards from a respective one of said pair of side rails of said main box to define an apex at an intersection of the side upright and said side rail; and a drop-in webbing assembly comprising:

a webbing frame including a forward spring rail and a rearward spring rail separated by a pair of cross rails, wherein each end of said rearward spring rail extends laterally beyond each of said cross rails to define a pair of protruding portions of said rearward spring rail;

a central girder attached to mid-portions of each of said elongate frame members; and a webbing spanning between said forward spring rail and said rearward spring rail, wherein said pair of side rails and said pair of side uprights cooperate to define a pair of rearward notches, one at each apex, each of said rearward notches including a first lead-in structure defined by the respective side upright of the respective apex and a second lead-in structure defined by the respective side rail of the respective apex; and wherein said protruding portions of said rearward spring rail are disposed in said pair of rearward notches.

2. The seat box of claim 1, wherein said second lead-in structure of each rearward notch is a chamfered lead-in structure.

3. The seat box of claim 1, wherein said webbing comprises a plurality of webbing straps.

4. The seat box of claim 1, wherein said drop-in webbing assembly is removably attached to said main box and back frame as a unit with said webbing and said central girder attached thereto.

5. The seat box of claim 1, wherein said central girder comprises a wooden material.

6. The seat box of claim 2, wherein each of the side rails of said pair of side rails further comprises structure defining a forward notch proximate said front rail.

7. The seat box of claim 6, wherein each of said forward notches includes a third lead-in structure.

8. The seat box of claim 7, wherein said third lead-in structure comprises chamfered lead-in structure.

9. The seat box of claim 8, wherein a tapered face said chamfered lead-in structure of said second lead-in structure faces in a direction towards said back rail and a tapered face of said chamfered lead-in structure of said third lead-in structure faces in a direction towards said front rail.

10. The seat box of claim 1, wherein:

said central girder includes a forward block and a rearward block connected by a cross member, said forward block including a first notch formed thereon, said rearward block including a second notch formed thereon;

said forward spring rail is disposed in said first notch of said forward block; and said rearward spring rail is disposed in said second notch of said rearward block.

11. The seat box of claim 10, wherein:

said forward block includes an extension portion that extends beyond said forward block in a forward direction;

said front rail defines a notch that is open to an upper edge of said front rail; and said extension portion of said forward block is registered in said notch of said front rail.

12. The seat box of claim 10, wherein:

said rearward block includes an extension portion that extends beyond said second notch of said rearward block in a rearward direction;

said back rail defines a notch that is open to a lower edge of said back rail; and said extension portion of said rearward block is registered in said notch of said back rail.

13. The seat box of claim 10, wherein a lateral face of said rearward block is affixed to a lateral face of said middle upright.

14. The seat box of claim 13, wherein:

a back end of the central girder includes a rearward face having a rearward face area;

an overlapping contact area is defined between said lateral face of said rearward block and said lateral face of said middle upright; and said overlapping contact area is greater than said rearward face area of said central girder.

15. The seat box of claim 14, wherein an area ratio of said overlapping contact area to said rearward face area of said central girder is between 2 and 20 inclusive.

16. The seat box of claim 15, wherein said area ratio is between 2 and 10 inclusive.

17. The seat box of claim 16, wherein said area ratio is between 4 and 10 inclusive.

18. A method of assembling a seat box, comprising:

providing a sub assembly comprising:

a main box including a front rail and a back rail separated by a pair of side rails to define an interior space, said main box including upper edges that substantially define a plane; and a back frame assembly extending vertically from said main box, said back frame assembly including a pair of side uprights and a middle upright, each of the side uprights of said pair of side uprights extending upwards from a respective one of said pair of side rails of said main box to define an apex at the intersection of the side upright and said side rail, wherein said pair of side rails and said pair of side uprights cooperate to define a pair of rearward notches, one at each apex, each of said rearward notches including a first lead-in structure defined by the respective side upright of the respective apex and a second lead-in structure defined by the respective side rail of the respective apex;

providing a drop-in webbing assembly comprising:

a webbing frame including a forward spring rail and a rearward spring rail separated by a pair of cross rails, wherein each end of said rearward spring rail extends laterally beyond each of said cross rails to define a pair of protruding portions of said rearward spring rail;

a central girder attached to mid-portions of each of said elongate frame members, said central girder including a rearward block affixed to said rearward spring rail of said webbing frame; and a webbing spanning between said forward spring rail and said rearward spring rail, inserting said drop-in webbing assembly into said interior space of said main box so that said rearward block of said central girder is immediately adjacent a lateral face of said middle upright of said back frame assembly, said drop-in webbing assembly being inserted at an acute angle relative to said plane of said upper edges of said main box;

disposing each protruding portion of said pair of protruding portions into a respective one of said rearward notches via said at least one lead-in structure;

rotating said drop-in webbing assembly about said rearward spring rail when said pair of protruding portions are lodged within said rearward notches, so that said forward spring rail is rotated towards said main box; and registering said drop-in webbing assembly within said main box, so that said rearward spring rail is registered against the support faces of said rearward notches.

19. The method of claim 18, further comprising:

sliding said pair of protruding portions over said at least one lead-in structure to stretch said webbing frame.

20. The method of claim 19, wherein said at least one lead-in structure of each of said rearward notches of said subassembly provided in the step of providing a subassembly are chamfered lead-in structures.

21. A seat box assembly, comprising:

a drop-in webbing assembly comprising:

a webbing frame including a pair of elongate wood frame members comprising a forward wood spring rail and a rearward spring rail, the elongate frame members separated by a pair of wood cross rails positioned proximate ends of the elongate frame members, wherein each end of said rearward spring rail extends laterally beyond each of said cross rails to define a pair of protruding portions of said rearward spring rail;

a central wood girder attached to mid-portions of each of said elongate frame members, the central wood girder having notches into which the forward spring rail and rearward spring rail are seated, the central girder extending downwardly from each elongate frame member and then traversing between the forward spring rail and rearward spring rail, the girder being spaced from webbing spanning between the forward spring rail and rearward spring rail.

22. The seat box assembly of claim 21, further comprising:

a main box including a front rail and a back rail separated by a pair of side rails to define an interior space, the side rails each having a notch for receiving the drop in webbing assembly; and a back frame assembly extending vertically from said main box, said back frame assembly including a pair of side uprights each affixed to an interior face of said back rail, each of the side uprights extending upwards from a respective one of said pair of side rails of said main box;

wherein said drop in webbing assembly is received in the notches in said side rails of the main box.

23. The seat box assembly of claim 22, wherein each side rail has a forward notch and a rearward notch.

24. The seat box assembly of claim 23, wherein the rearward spring rail has a pair of ends that extend outwardly beyond the cross rails, and wherein each of the rearward notches is sized for receiving one of said ends.

* * * * *